United States Patent [19]

Gross et al.

[11] 4,443,734

[45] Apr. 17, 1984

[54] HIGH INTENSITY DISCHARGE LAMP WITH ARC SPREADING MEANS

[75] Inventors: Leo Gross, 3611 217 St., Bayside, N.Y. 11361; S. Merrill Skeist, Glen Head, N.Y.

[73] Assignee: Leo Gross, Bayside, N.Y.

[21] Appl. No.: 117,950

[22] Filed: Feb. 4, 1980

[51] Int. Cl.[3] ..... H01J 61/34; H01J 61/04

[52] U.S. Cl. ..... 313/26; 313/161; 313/607; 313/634

[58] Field of Search ..... 313/161, 220, 201, 25, 313/607, 634, 26; 315/248, 344

[56] References Cited

U.S. PATENT DOCUMENTS

| | | | |
|---|---|---|---|
| 1,286,882 | 12/1918 | Hewitt | 315/348 X |
| 1,935,940 | 11/1933 | Case | 313/201 X |
| 2,015,885 | 10/1935 | Dallenbach | 313/201 X |
| 2,149,224 | 2/1939 | McCauley | 313/201 X |
| 2,317,265 | 4/1943 | Foerste et al. | 313/220 X |
| 3,885,181 | 5/1975 | Nelson et al. | 313/220 X |
| 4,069,416 | 1/1978 | Suga | 313/161 |
| 4,100,446 | 7/1978 | Harada et al. | 313/161 |

*Primary Examiner*—Palmer C. Demeo

*Attorney, Agent, or Firm*—Lackenbach, Siegel, Marzullo, Presta & Aronson

[57] ABSTRACT

A high pressure discharge lamp having cylindrical or elliptical envelope containing a rare gas atmosphere as the starter gas and mercury and other volatile metals. The luminous output of this high intensity discharge lamp is increased by the presence of a magnetic field which spreads the arc discharge throughout the lamp envelope.

4 Claims, 5 Drawing Figures

HIGH INTENSITY DISCHARGE LAMP WITH ARC SPREADING MEANS

FIELD OF THE INVENTION

The present invention relates to high intensity arc discharge lamps. The application of varying magnetic fields broadens and stabilizes the arc, increasing light output in the process.

SUMMARY OF THE INVENTION

The present invention applies a varying magnetic field at right angles to the direction of the arc in a high intensity arc discharge lamp. The interaction of the magnetic field with the electric field within the arc broadens and stabilizes the arc discharge. By broadening the arc discharge, convection currents and instabilities are minimized, the arc temperature is raised and light output increased.

DETAILED DESCRIPTION OF THE INVENTION

Figure 1:
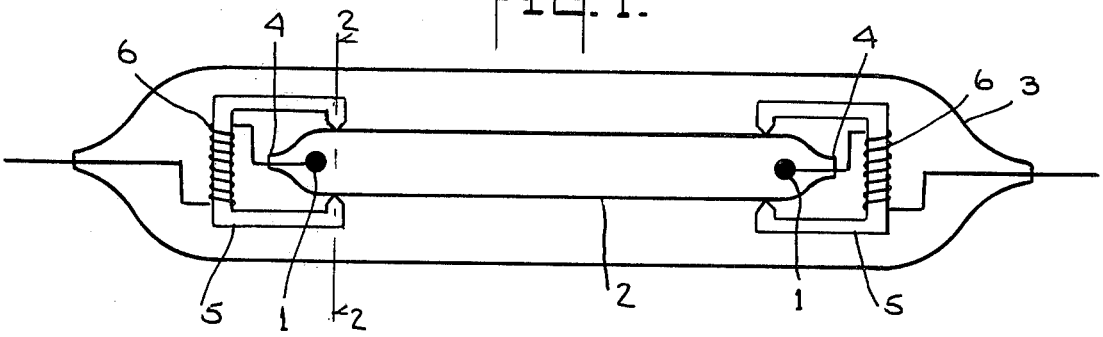
FIG. 1 is a view of one embodiment of a high intensity discharge lamp incorporating a magnetic field arc spreading coil.

In a high intensity discharge lamp the envelope contains a rare gas which acts as the starter for initiating the arc discharge across its electrodes. In a confined space, the mercury and other volatile metal halides are heated by the arc discharge. As the temperature of the metallic vapors rises, the atoms ionized by collision emit light, a larger proportion of which light quanta are in the visible and low ultra violet than when the arc discharge is cool.

Lamp efficacy increases at higher temperatures when the electron gas and metallic ion and atom temperatures near equality. In high intensity discharge lamps as constructed till now, the bulb wall temperature is cooler with temperature rising as the center of the lamp is approached, which region is the hottest by virtue of the high current density at the center of the arc. The bulb walls are cooled by heat conduction, and the volume near the bulb wall operates at lower efficacy than at the center of the lamp which is coincident with the region of highest current density in the arc discharge. (J. Waymouth-Electric Discharge Lamps, MIT Press, 1971).

In accordance with the concepts of the present invention this temperature difference can be minimized and light output increased by spreading the arc throughout the volume of the lamp envelope with a varying magnetic field transverse to the direction of the arc. Magnetic arc spreading distributes the arc energy more uniformly throughout the volume of the lamp minimizing the temperature differential throughout the cross section of the lamp. Such lamps operate with higher bulb wall temperatures and thus operate more efficiently.

When the high intensity arc discharge is established in the customary manner, the high pressure differentials existing between the cooler denser gas at the bulb wall and the heated atoms and ions in the less dense central arc discharge cause convection currents to flow within the lamp envelope. This has the effect of cooling the plasma rapidly and also permits instabilities to arise. The cause of these instabilities were identified by C. Kenty (On Convection Currents in High Pressure Mercury Arcs, J.Appl.Phys. 9:53, 1938). More recently, R. J. Zollweg has reported on the theory of these instabilities. (Arc Instability in Mercury and Metal Halide Arc Lamps, J.Illum.Eng.Soc. 9:90, 1979) where Zollweg commented that when the "Self magnetic force (generated by the arc's own current flow) exceeds the wall stabilizing forces, then there is a change in the arc column configuration from a cylindrical to a helical form". When a high intensity discharge lamp is operated in a horizontal position, the arc may bow or bend upwards in the center which may lead to instability. This bowing due to convection is constrained by an axial magnetic field generated by coaxial windings over the lamp electrodes in a patent by Drop et, al. (High Pressure Tin Halide Discharge Lamps, U.S. Pat. No. 4,001,626, Jan. 4, 1977). This application of a magnetic field constrains and concentrates the arc discharge. A more effective use of the magnetic field is to disperse or spread the arc in a controlled manner. Magnetic arc spreading by distributing the arc current throughout the volume of the lamp also brings the arc closer to the bulb wall minimizing radiation imprisonment losses, and reducing temperature differentials which mitigates arc instabilities thereby improving high intensity arc lamp performance in the process.

Figure 2:
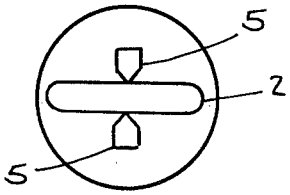
FIG. 2 is a vertical sectional view of the lamp taken along the plane of Line 2—2 in FIG. 1.

A high intensity arc discharge lamp embodying the invention is shown in FIG. 1. The arc discharge is established between the electrodes 1, sealed within the lamp envelope 2. The lamp envelope is supported within a protective outer envelope 3 by supports 4 pinched into the flattened and fused together ends of the envelope 1. The supports hold the magnetic cores 5 in place with pole pieces located just beyond the electrodes. The magnets are energized by coils 6 wound on the cores. The coils are wired in series with the electrodes and serve as part of the ballast for the lamp as well as providing the magnetic fields for arc spreading. The length of the arc discharge tube is approximately 5 cm or less with a diameter 2 cm or less where the lamp is designed for 400–500 watt dissipation. Other dimensions are required in proportion to lamp wattage. Arc spreading efficiency is improved for other than circular cross section. A flattened elliptical cross section, as shown in FIG. 2, is one of several constructions desirable with magnetic arc spreading.

Figure 3:
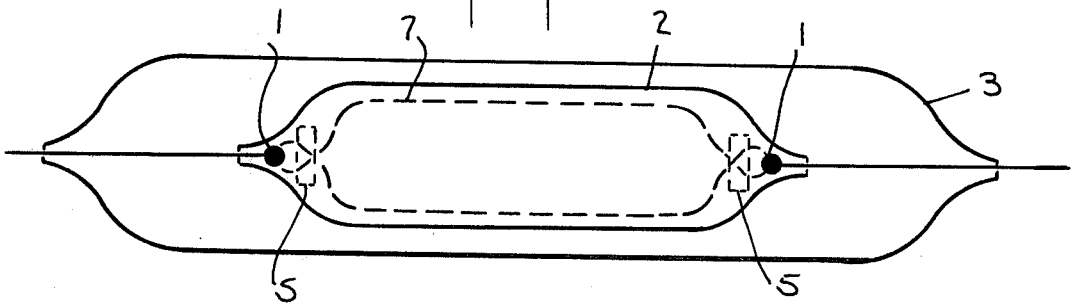
FIG. 3 Schematically illustrates the arc coverage with arc spreading operating.

When the lamp is operating, magnetic arc spreading causes the arc to occupy cyclically all positions between the limits of the arc excursion as illustrated in FIG. 3. The lamp envelope 2 is schematically represented in this view wherein a pole of the arc spreading coils 5 beneath the lamp is shown in the location just beyond the electrodes 1. The limits of arc excursion are reached periodically at each peak of the applied alternating current.

Figure 4:
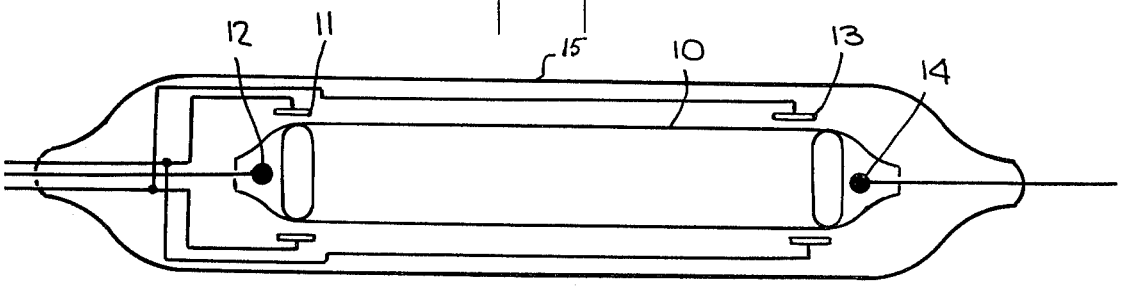
FIG. 4 is a view of an embodiment of a high intensity discharge lamp utilizing an electric field to spread the arc discharge.

Referring now to FIG. 4, there is shown an arrangement in which the inner envelope 10 of the high intensity arc discharge lamp is provided with electrodes 12 and 14 and is supported within a protective outer envelope 15. To spread the arc discharge, an electric field is established by one pair of electrode plates 11 disposed within the outer envelope adjacent electrode 12 and by a second pair of electrode plates 13 adjacent electrode 14.

Figure 5:
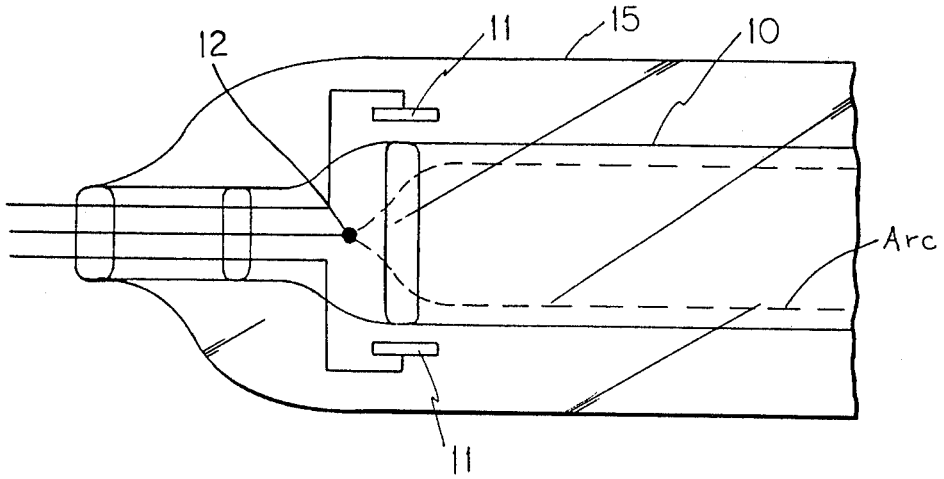
FIG. 5 is a schematic view of a preferred form of the invention wherein the inner and outer envelopes have their ends flattened together.

The arrangement shown in FIG. 5 is the same as that in FIG. 4, except that in this instance the ends of the inner and outer envelopes are flattened together.

We claim:

1. A high intensity discharge lamp comprising:

A. an inner envelope having flattened ends and containing a rare gas;

B. electrodes in said inner envelope for creating with said rare gas an arc discharge;

C. arc spreading means associated with the flattened ends of said inner envelope for creating a transverse electric field to spread the arc discharge; and D. an outer envelope surrounding said inner envelope, said outer envelope having its ends flattened together with the ends of said inner envelope.

2. A lamp according to claim 1, wherein said envelope between said flattened ends is of an elliptical cross section.

3. A lamp according to claim 2, wherein said envelope between said flattened ends is of a flattened cross section.

4. A lamp according to claim 1, including support means positioned and secured on said flattened ends of said inner envelope, said support means supporting said arc spreading means.

* * * * *